US010612292B2

(12) United States Patent
Lee et al.

(10) Patent No.: US 10,612,292 B2
(45) Date of Patent: Apr. 7, 2020

(54) WINDOW SYSTEM

(71) Applicant: KOREA INSTITUTE OF CONSTRUCTION TECHNOLOGY, Goyang-si, Gyeonggi-do (KR)

(72) Inventors: Keon Ho Lee, Goyang-si (KR); Bo Kyoung Koo, Seoul (KR); Bo Rang Park, Seoul (KR); Ki Tae Kim, Incheon (KR)

(73) Assignee: KOREA INSTITUTE OF CONSTRUCTION TECHNOLOGY, Goyang-si (KR)

( * ) Notice: Subject to any disclaimer, the term of this patent is extended or adjusted under 35 U.S.C. 154(b) by 0 days.

(21) Appl. No.: 15/536,644

(22) PCT Filed: May 27, 2015

(86) PCT No.: PCT/KR2015/005280
§ 371 (c)(1),
(2) Date: Jun. 19, 2017

(87) PCT Pub. No.: WO2016/098967
PCT Pub. Date: Jun. 23, 2016

(65) Prior Publication Data

US 2017/0342765 A1 Nov. 30, 2017

(30) Foreign Application Priority Data

Dec. 18, 2014 (KR) ..... 10-2014-0183436

(51) Int. Cl.
*E06B 3/263* (2006.01)
*E06B 3/67* (2006.01)
(Continued)

(52) U.S. Cl.
CPC ..... *E06B 3/2632* (2013.01); *E06B 3/28* (2013.01); *E06B 3/6715* (2013.01); *E06B 7/02* (2013.01);
(Continued)

(58) Field of Classification Search
CPC . E06B 7/02; E06B 3/2632; E06B 3/67; E06B 3/6715
(Continued)

(56) References Cited

U.S. PATENT DOCUMENTS 1,436,951 A * 11/1922 De Waters ..... E06B 3/52 16/362
1,957,279 A * 5/1934 Linke ..... C03C 1/10 126/628
(Continued)

FOREIGN PATENT DOCUMENTS

JP 2006328915 A * 12/2006
KR 10-2010-0065082 A 6/2010
(Continued)

OTHER PUBLICATIONS

Kim, KR 10-2013-0085456 A English machine translation, Jul. 30, 2013.*
(Continued)

*Primary Examiner* — Grant Moubry
*Assistant Examiner* — Phillip Decker
(74) *Attorney, Agent, or Firm* — Hershkovitz & Associates, PLLC; Abe Hershkovitz

(57) ABSTRACT

A window system according to an aspect of the invention includes: a window frame; an inner window installed at an indoor side of the window frame; an outer window fixed to the window frame and spaced apart from the inner window with a predetermined distance at an outdoor side to form a hollow layer between the outer window and the inner
(Continued)

window; an air-flowing opening formed between the outer window and the window frame to form a flow path in which air in the hollow layer flows or circulates; and an opening and closing device provided at one side of the inner window to open and close the inner window from the window frame. The outer window may include a tinted glass or a glass having a high absorption rate and a bracket for fixing the tinted glass to the window frame.

19 Claims, 6 Drawing Sheets

(51) Int. Cl.
*E06B 3/28* (2006.01)
*E06B 7/02* (2006.01)
*F24F 13/18* (2006.01)

(52) U.S. Cl.
CPC ..... *E06B 2003/26352* (2013.01); *E06B 2007/026* (2013.01); *F24F 13/18* (2013.01)

(58) Field of Classification Search
USPC ..... 454/196
See application file for complete search history.

(56) References Cited

U.S. PATENT DOCUMENTS 2,535,933 A * 12/1950 Kubatzky ..... E06B 7/02 454/225
4,295,417 A * 10/1981 Isley ..... E06B 7/02 454/196
4,641,466 A * 2/1987 Raninen ..... E06B 7/02 52/171.3
6,412,225 B1 * 7/2002 McManus ..... B62D 31/02 49/381
6,579,169 B1 * 6/2003 Demark ..... E06B 7/02 454/200
8,137,814 B2 * 3/2012 Barton ..... B32B 17/10036 428/34
2003/0083188 A1 * 5/2003 Seto ..... C03C 3/087 501/71
2007/0161345 A1 * 7/2007 Chato ..... E06B 7/02 454/196
2009/0104867 A1 * 4/2009 Sherman ..... E06B 7/02 454/205
2012/0318475 A1 * 12/2012 Glover ..... F24D 5/02 165/47
2017/0122608 A1 * 5/2017 Havia ..... E06B 7/10

FOREIGN PATENT DOCUMENTS

KR 10-2011-0070717 A 6/2011
KR 10-2011-0089970 A 8/2011
KR 10-1220221 B1 1/2013
KR 10-2013-0085456 A 7/2013
KR 20130115608 A * 10/2013

OTHER PUBLICATIONS

Lee, KR 10-2011-0070717 A English machine translation, Jun. 24, 2011.*
Lee et al., KR 10-1220221 B1 English machine translation, Jan. 3, 2013.*
Jo, KR 2011-0089970 A English machine translation, Aug. 10, 2011 (Year: 2011).*
Office Action dated Feb. 22, 2015 in corresponding KRA10-2014-0183436.
English language Abstract of KR 10-2013-0085456 A, Jul. 30, 2013.
English language Abstract of KR 10-2011-0070717 A, Jun. 24, 2011.
English language Abstract of KR 10-1220221 B1, Jan. 9, 2013.
English language Abstract of KR 10-2011-0089970 A , Aug. 10, 2011.
English language Abstract of KR10-2010-0065082 A, Jun. 15, 2010.

* cited by examiner

WINDOW SYSTEM

TECHNICAL FIELD

Embodiments of the invention relate to a window system, and more particularly, to a window system able to reduce energy consumption in buildings.

BACKGROUND OF THE INVENTION

Recently, due to effect of global warming, the air conditioner has been used longer. Also, by an increase of a facade glass area, an increase of office automation (OA) apparatuses, and by a high demand for indoor comfort, energy consumption for cooling, has continuously increased. Accordingly, there is a growing demand for solar radiation protection through exterior materials, more particularly, windows. This phenomenon occurs especially at most high-rise buildings.

A double-skin window system has been disclosed in Korean Patent No. 10-1010203 on Jan. 17, 2011, in which a hollow layer is formed inside the double-skin window, and a window shade or a blind is provided in the hollow layer to control an incidence of solar heat.

Also, since the hollow layer has a structure able to be naturally ventilated, it is possible to discharge the heat of the hollow layer due to the solar radiation to the outside, thereby contributing to a load reduction in cooling a room.

However, when the window shade is installed in the hollow layer, a width of the hollow layer increases, and accordingly, a thickness of the double-skin also increases. This causes a construction cost to increase more than twice as much compared to a single-skin window system.

In addition, in the conventional double-skin window system, maintenance of the window shade or the blind is not easy because the window shade or the blind is installed inside the hollow layer.

Conventionally, the double-skin window system requires a separate apparatus having a power-driven device in order to ideally operate the window shade or the blind in accordance with a season. If the window shade or the blind is operated manually without a power transmission device, the double-skin window system may be operated unreasonably in terms of energy and comfort aspects, and out of season since the user does not sufficiently know an operation and a mechanism of the double-skin window system.

The present invention has been made in view of the above problems, and an object of the present invention is to provide a window system able to block solar radiation without installing a window shade or a blind.

An amount of light transmitted through an inner glass increases when the light is in a form of light. Considering this, in embodiments of the invention, light is converted into heat by an outer glass having a high absorption rate, and the heat is blocked by an inner glass having a high heat insulating performance, to thereby effectively block solar radiation.

It is another object of the invention to provide a window system for blocking solar radiation with a simple structure and a slim structure, having a small thickness of an entire window system and a small thickness of an entire glass.

A transmittance of solar radiation is kept the same and thus, an indoor illumination is the same, but solar radiation heat can be blocked more, by about 30% or more, in the window system according to embodiments of the present invention compared with a conventional window system having the same glass.

It is still another object of the invention to provide a window system in which maintenance of a window shade or a blind is not required.

It is yet another object of the invention to provide a window system capable of performing the above various functions.

A window system according to an embodiment of the invention made to achieve the above objects includes: a window frame; an inner window installed at an indoor side of the window frame; an outer window fixed to the window frame and spaced apart from the inner window within a predetermined distance at an outdoor side to form a hollow layer between the outer window and the inner window; an air-flowing opening formed between the outer window and the window frame to form a flow path in which air in the hollow layer flows or circulates; and an opening and closing device provided at one side of the inner window to open and close the inner window from the window frame. The outer window may include a tinted glass and a bracket for fixing the tinted glass to the window frame.

The air-flowing opening may include an air-supplying opening formed between a lower end of the window frame and a lower end of the outer window, so that air is supplied from an outside, and an air-discharging opening formed between an upper end of the window frame and an upper end of the outer window, to discharge the air introduced into the hollow layer through the air-supplying opening.

Normally, the air-supplying opening and the air-discharging opening may be configured to be open at all times. However, if it is necessary to further improve an insulation performance of the window system, or if it is necessary to cope with dusty outdoor conditions, the air-supplying opening and the air-discharging opening may be provided with an opening and closing frame for opening and closing the air-supplying opening and the air-discharging opening, as necessary.

The opening and closing frame may include a first frame installed at the outer window; a second frame installed at the inner window or the window frame; a support member provided between the first frame and the second frame to prevent sagging of the second frame; finishing members, each provided at both ends of the first frame and the second frame and coupled to both ends of the first frame and both ends of the second frame; and a filter screen disposed between the first frame and the second frame and extending along a longitudinal direction of the air-flowing openings, to prevent dust or foreign matter from flowing into the hollow layer through the air-flowing openings.

The window system may further include a cover provided at a front side of the filter screen to prevent air from flowing or circulating in the hollow layer through the air-flowing openings.

The opening and closing device may include a first coupling member, including a first coupling portion coupled to the window frame and a first connecting portion extending from the first coupling portion; a second coupling member including a second coupling portion coupled to an end of the inner window and a second connecting portion extending from the second coupling portion and being connected to the first coupling portion; and a rotating shaft coupled to the first connecting portion and the second connecting portion to rotate the second coupling member with respect to the first coupling member.

The inner window may include a pair glass; and a pair-glass frame to which the pair glass is fixed. The pair glass may include a first glass; and a second glass being spaced apart from the first glass by a predetermined distance and being a low-e coated glass. The better the heat insulating performance of the glass applied to the inner window, the greater the effect of controlling the solar radiation.

The outer window may be made of a single glass or a laminated glass. For the outer window, at least one of a transparent glass having a high absorption rate, a tinted glass having a slightly low transmittance and having a blue or green color, or a transmittance-controlling glass which transmittance can be controlled may be applied. When the tinted glass is applied, an absorption rate of the front portion is increased and a solar heat gain coefficient (SHGC) of a front portion can be further lowered. Especially, when the transmittance-controlling glass is applied, a solar heat gain coefficient (SHGC) can be further reduced.

Also, a window system according to another aspect of the invention includes: a window frame; an inner window installed at an indoor side of the window frame; an outer window fixed to the inner window and spaced apart from the inner window with a predetermined distance at an outdoor side to form a hollow layer between the outer window and the inner window; an air-flowing opening formed between the outer window and the window frame to form a flow path in which air in the hollow layer flows or circulates; and an opening and closing device provided at one side of the inner window to open and close the inner window and the outer window from the window frame at the same time. The outer window may include a tinted glass, a tinted-glass frame to which the tinted glass is fixed and being coupled to the inner window, and a frame cover for covering a part of the tinted-glass frame.

The air-flowing openings may include an air-supplying opening formed between a lower end of the window frame and a lower end of the outer window so that air is supplied from an outside, and an air-discharging opening formed between an upper end of the window frame and an upper end of the outer window to discharge the air introduced into the hollow layer through the air-supplying opening.

If it is necessary to further improve an insulation performance of the window system or if it is necessary to cope with dusty outdoor conditions, the air-supplying opening and the air-discharging opening may be provided with an opening and closing frame for opening and closing the air-supplying opening and the air-discharging openins.

The opening and closing frame may include a first frame installed at the outer window; a second frame installed at the inner window or the window frame; a support member provided between the first frame and the second frame to prevent sagging of the second frame; finishing members, each provided at both ends of the first frame and the second frame, and coupled to the both ends of the first frame and the both ends of the second frame; and a filter screen disposed between the first frame and the second frame and extending along a longitudinal direction of the air-flowing openings to prevent dust or foreign matter from flowing into the hollow layer through the air-flowing openings.

The window system may further include a cover provided at a front side of the filter screen to prevent air from flowing or circulating in the hollow layer through the air-flowing openings.

The opening and closing device may include a first coupling member including a first coupling portion coupled to the window frame and a first connecting portion extending from the first coupling portion; a second coupling member including a second coupling portion coupled to an end of the inner window and a second connecting portion extending from the second coupling portion and being connected to the first coupling portion; and a rotating shaft coupled to the first connecting portion and the second connecting portion to rotate the second coupling member with respect to the first coupling member.

The tinted-glass frame may include: a fixing portion to which the tinted glass is fixed; and an inner-window coupling portion, wherein one surface of the inner-window coupling portion facing or being in contact with the inner window to be coupled to the inner window.

For the outer window, a transparent glass having a high absorption rate or a tinted glass having a blue or green color may be applied.

According to a window system according to the invention, solar radiation heat can be blocked without installing a window shade or a blind at an outside or a hollow layer, thereby reducing cooling load in summer.

A transmittance of solar radiation is kept the same and thus an indoor illumination is the same, but solar radiation heat can be blocked more by about 30% or more in the window system according to embodiments of the invention, compared with a conventional window system having the same glass.

Also, since a window shade or a blind is not installed, a structure of the window system can be simple, and the window system can be slim to have a small thickness.

In addition, since a window shade or a blind is not installed, maintenance of the window shade or the blind is not necessary and thus the maintenance cost can be reduced.

DETAILED DESCRIPTIONS OF THE EMBODIMENTS

Hereinafter, a window system according to embodiments of the invention will be described in detail with reference to the accompanying drawings.

Figure 1:
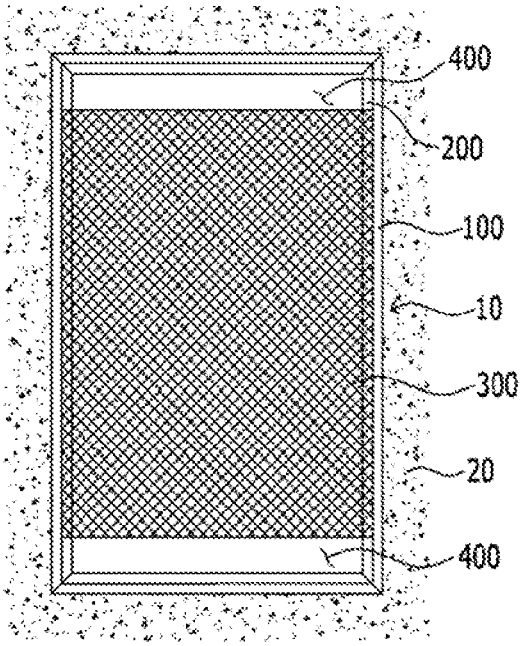
FIG. 1 is a front view of a window system according to an embodiment of the invention.
Figure 2:
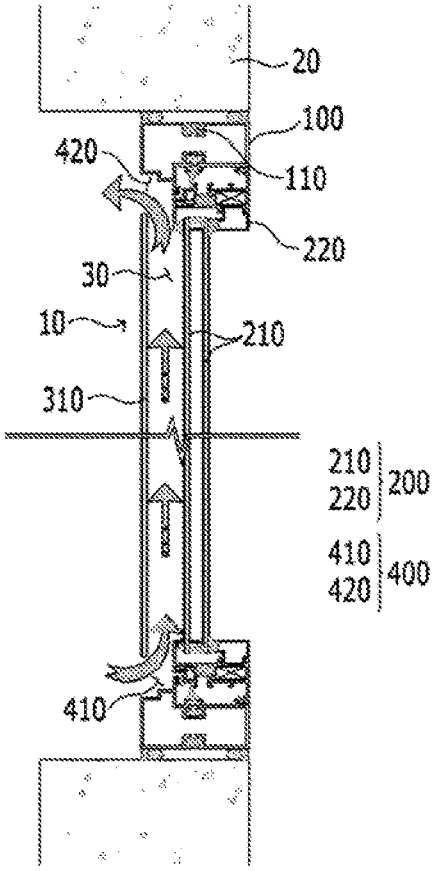
FIG. 2 is a longitudinal sectional view of a window system according to an embodiment of the invention.

FIG. 1 is a front view of a window system according to an embodiment of the invention, and FIG. 2 is a longitudinal sectional view of a window system according to an embodiment of the invention.

As shown in FIGS. 1 and 2, a window system 10 according to an embodiment of the invention may include a window frame 100, an inner window 200, an outer window 300, and an air-flowing openings 400. The inner window 200 may be installed at an indoor side of the window frame 100. The outer window 300 may be fixed to the window frame 100 and spaced apart from the inner window 200 with a predetermined distance at an outdoor side to form a hollow layer 30 between the outer window 300 and the inner window 200. The air-flowing openings 400 may be formed between the outer window 300 and the window frame 100 to form a flow path in which air in the hollow layer 30 flows or circulates.

The window frame 100 is fixed to a structural member 20 by being in direct contact with the structural member 20. Thereby, the inner window 200 and the outer window 300 installed at the window frame 100 can be fixed to the structural member 20. The window frame 100 may be made of a metal or a resin such as poly vinyl chloride (PVC). In order to prevent a thermal bridge through the window frame 100, the window frame 100 may be provided with a thermal-bridge breaking member 110 at an inside of the window frame 100.

The inner window 200 is provided on the inner side of the window frame 100 to block an inflow of solar radiation. The inner window 200 may include a pair glass 210, and a pair-glass frame 220 to which the pair glass 210 is fixed. The pair glass 210 may have a thickness of 24 mm. The pair glass 210 may include a first glass 211, and a second glass 212 being spaced apart from the first glass 211 by a predetermined distance and being a low-e coated glass. The second glass 212 of the low-e coated glass is a high insulation glass having an excellent heat-insulation performance. Therefore, the second glass 212 of the low-e coated glass can ensure high heat insulation performance of an interior of building or a room in winter and can prevent a large amount of heat generated at the hollow layer 30 formed between the inner window 200 and the outer window 300 from inflowing into the interior or the room.

On the other hand, the outer window 300 may have a thickness of 7 mm. The outer window 300 may include a transparent glass having a high absorption rate. Alternatively, the outer window 300 may include a tinted glass 310 having a blue or green color in order to effectively prevent solar radiation. In some cases, a transmittance controlling glass may be applied. The blue or green color used in the tinted glass 310 has a relatively high ultraviolet (UV)-blocking effect as compared with other colors, reduces an fatigue of eyes, and reliefs a tension of a nerve. Therefore, by using the tinted glass 310 having the blue or green color, a person indoor can be protected from ultraviolet rays and can gain psychological stability, and the fatigue of the eyes of the person indoor can be reduced.

The tinted glass 310 has a low transmittance of 40% or less, while has a high absorption rate. Accordingly, by increasing a temperature of the hollow layer 30 located behind the tinted glass 310, ventilation in the hollow layer 30 through the air-flowing opening 400 can be actively generated.

When the inner window 200 and the outer window 300 are combined as described above, a solar heat gain coefficient (SHGC) can be less than 30%, and can be maintained 20% or less by the ventilation in the hollow layer 30. The solar heat gain coefficient is a sum of a ratio of solar energy directly transmitted through a window to a room and a ratio of solar energy re-introducing to the room in a form of convection and infrared long-wave radiation, with respect to solar energy reaching the window. Therefore, the solar radiation can be prevented from inflowing into the room without installing a window shade or a blind at the hollow layer 30.

On the other hand, the air-flowing opening 400 may include an air-supplying opening 410 and an air-discharging opening 420. The air-supplying opening 410 may be formed between a lower end of the window frame 100 and a lower end of the outer window 300 so that air is supplied from an outside. The air-discharging opening 420 may be formed between an upper end of the window frame 100 and an upper end of the outer window 300 to discharge the air introduced into the hollow layer 30 through the air-supplying opening 410. The air-supplying opening 410 and the air-discharging opening 420, which do not use a separate opening and closing system, are always opened, so that the ventilation of the hollow layer 30 can be continuously performed.

Next, an opening and closing method of the window system 10 will be described in more detail.

In the following description, only the portions different from the above-described embodiment will be described in detail and detailed descriptions of the same or similar portions will be omitted.

Figure 3:
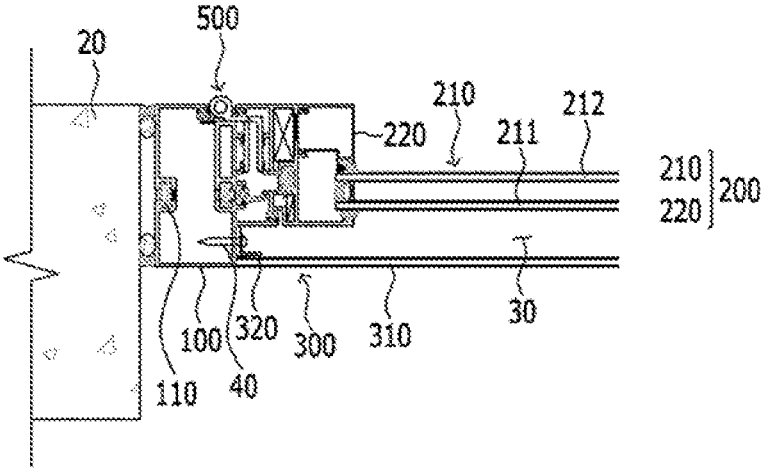
FIG. 3 is a first cross-sectional view of a window system according to an embodiment of the invention.
Figure 4:
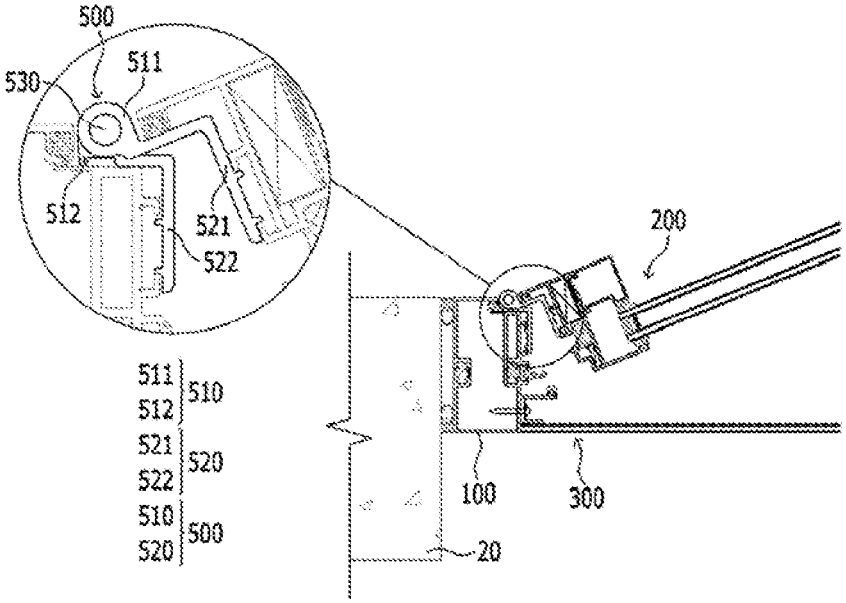
FIG. 4 is a second cross-sectional view of a window system according to an embodiment of the invention.

FIG. 3 is a first cross-sectional view of a window system according to an embodiment of the invention, and FIG. 4 is a second cross-sectional view of a window system according to an embodiment of the invention.

As shown in FIGS. 3 and 4, a window system 10 according to an embodiment of the invention may include an opening and closing device 500 provided at one side of an inner window 200 to open and close the inner window 200 from a window frame 100.

As described above, the outer window 300 is fixed to the window frame 100. The outer window 300 may be fixed to the window frame 100 by connecting a tinted glass 310 to a bracket 320, and then, coupling the bracket 320 to the window frame 100 through a bolt 40.

Therefore, the outer window 300 is fixed to the window frame 100, and only the inner window 200 can be open to an inside of a room by the opening and closing device 500.

Since the inner window 200 can be open to the inside of the room, the hollow layer 30 can be open. Accordingly, dust and foreign matter introduced through the air-flowing opening 400 can be easily removed or maintenance such as repair of the outer window 300 can be easily performed.

In addition, ventilation of a room can be performed by introducing outside air inflowing into the hollow layer 30 through the air-flowing opening 400 into the room in a state that sunlight is blocked by the outer window 300 and the inner window 200 is open.

On the other hand, the opening and closing device 500 may include a first coupling unit 510, a second coupling unit 520, and a rotating shaft 530. The first coupling unit 510 may include a first coupling portion 511 coupled to the window frame 10 and a first connecting portion 512 extending from the first coupling portion 511. The second coupling unit 520 may include a second coupling portion 521 coupled to an end of the inner window 200 and a second connecting portion 522 extending from the second coupling portion 521 and being connected to the first coupling portion 511. The rotating shaft 53 may be coupled to the first connecting portion 512 and the second connecting portion 512 to rotate the second coupling unit 520 with respect to the first coupling unit 510.

In the embodiment, it is illustrated that each of the first and second coupling members 510 and 520 have a shape of an 'L' or shape. However, the invention is not limited thereto. Thus, the first and second coupling members 510 and 520 may have any of various shapes depending on types or structures of the window frame 100 and the inner window 200.

In normal condition, a part of the first connecting portion 512 of the first coupling member 510 and a part of the second connecting portion 522 of the second coupling member 520 are overlapped with each other. If the inner window 200 is necessary to be opened, the inner window 200 is open to an inside of a room by separating the second connecting portion 522 from the first connecting portion 512.

Although not shown in drawings, a handle may be formed at the other end of the inner window 200 where the opening and closing device 500 is not provided. The inner window 200 can be opened or closed through an operation of the handle.

Next, a window system 10 according to a modified embodiment will be described. In the following description, only the portions different from the above-described embodiment will be described in detail and detailed descriptions of the same or similar portions will be omitted.

Figure 5:
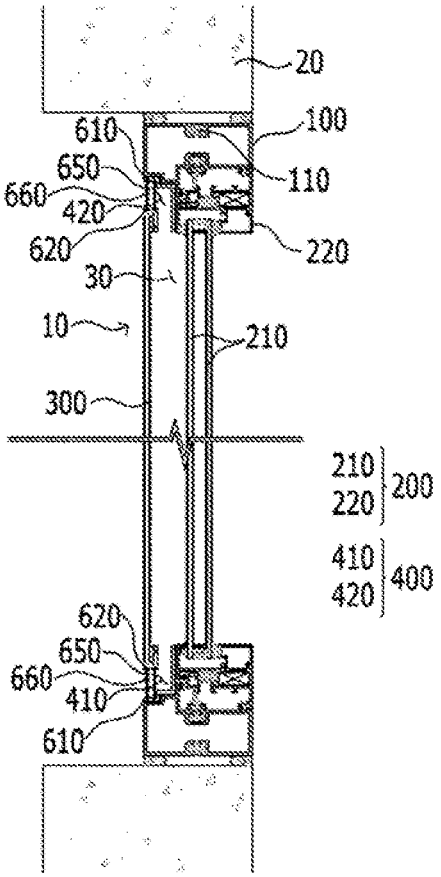
FIG. 5 is a longitudinal sectional view of a window system according to a modified embodiment of the invention.
Figure 6:
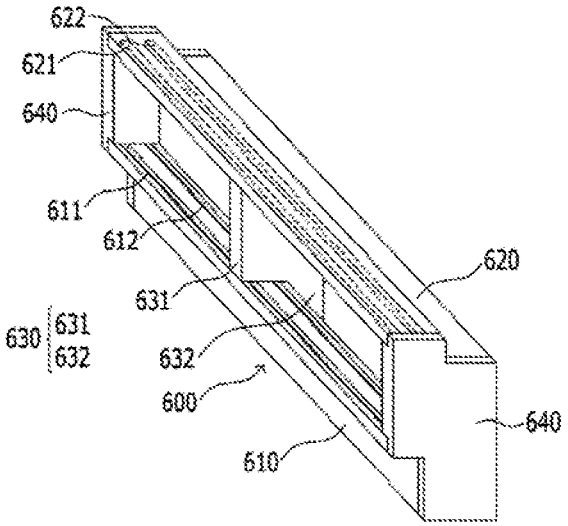
FIGS. 6, 7 and 8 are perspective views showing an opening and closing frame of a window system according to an embodiment of the invention.
Figure 7:
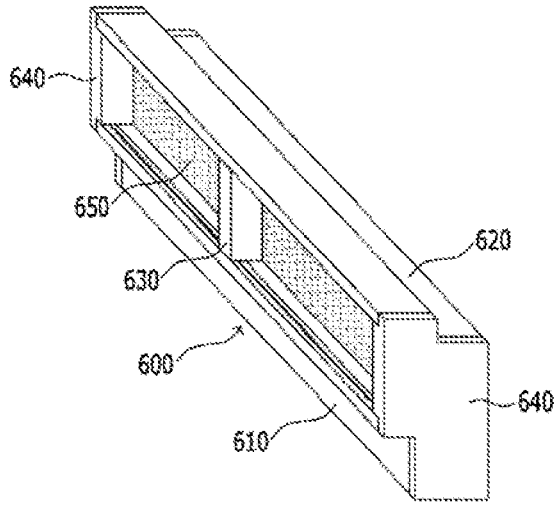
Figure 8:
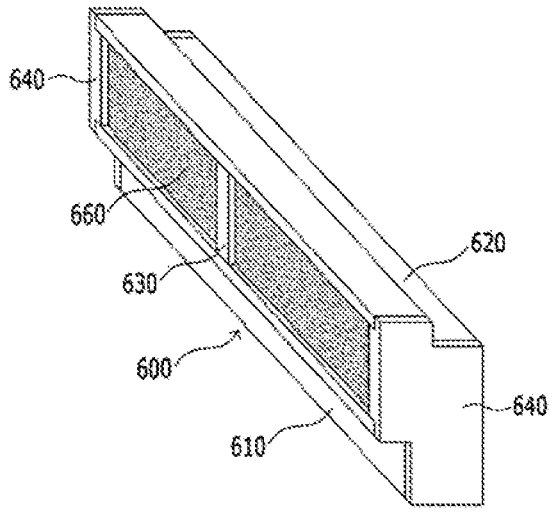

FIG. 5 is a longitudinal sectional view of a window system according to a modified embodiment of the invention, and FIGS. 6 and 8 are perspective views showing an opening and closing frame of a window system according to an embodiment of the invention.

As shown in FIGS. 5 to 8, an air-supplying opening 410 and an air-discharging opening 420 of a window system 10 according to an embodiment of the invention are provided with an opening and closing frame 600 for opening and closing the air-supplying opening 410 and the air-discharging opening 420.

The opening and closing frame 600 may include a first frame 610, a second frame 620, a support member 630, finishing members 640, and a filter screen 650. The first frame 610 may be installed at the outer window 300. The second frame 620 may be installed at the inner window 20 and the window frame 100 by facing or being in contact with the inner window 200 and the window frame 100 at the same time. The support member 630 may be provided between the first frame 610 and the second frame 620. Each of the finishing members 640 may be provided at both ends of the first frame 610 and the second frame 620, and thus, may be coupled to the both ends of the first frame 610 and the both ends of the second frame 620. The filter screen 650 may be disposed between the first frame 610 and the second frame 620 and may extend along a longitudinal direction of the air-flowing opening 400.

Further, a cover 660 may be further provided at a front side of the filter screen 650.

The first frame 610 may extend longitudinally along upper and lower portions of the outer window 300 and may have a 'L' or '¬" shape. The first frame 610 may face of be in contact with a part of an upper inner side and a part of a lower inner side of the outer window 300.

The second frame 620 may have a 'L' or '¬'-shape, like the first frame 610. A surface of the second frame 620 may face or be in contact with a part of an upper portion or a lower portion of the window frame 100 and another surface of the second frame 620 may face or be in contact with the inner window 200.

Also, the first frame 610 may have an outer groove 611 into which a part of the cover 660 is inserted and an inner groove 612 into which a part of the filter screen 650 is inserted. Similarly, the second frame 620 may have an outer groove 621 into which a part of the cover 660 is inserted and an inner groove 622 into which a part of the filter screen 650 is inserted. The outer grooves 611 and 621 and the inner grooves 612 and 622 provided at the first frame 610 and the second frame 620 are collinearly positioned on the same line in a vertical direction so that the cover 660 and the filter screen 650 are not coupled in a diagonal or inclined direction. In addition, the cover 660 and the filter screen 650 are coupled to the first frame 610 and the second frame 620 through being fitted to or inserting into the outer grooves 611 and 621 and the inner grooves 612 and 622. Since the cover 660 and the filter screen 650 can be easily coupled to and separated from the first frame 610 and the second frame 62, the maintenance can be conveniently performed.

The support member 630 provided between the first frame 610 and the second frame 620 may include a body portion 631 and an extension portion 632. Upper and lower portions of the body portion 631 may cross the outer grooves 611 and 621 and the inner grooves 612 and 622 provided at the first frame 610 and the second frame 620. At least one of the body portion 631 may be provided. The body portion 631 supports the second frame 620, thereby preventing the second frame 620 from sagging. The extension portion 632 extends from the body portion 631 toward the air-supplying opening 410 or the air-discharging opening 420 and is inserted into the air-supplying opening 410 or the air-discharging opening 420 so that the support member 630 is more stably provided between the first frame 610 and the second frame 620.

A structural stability of the opening and closing device 500 can be improved by integrating the first frame 610 and the second frame 620 through the finishing members 640 provided at the both ends of the first frame 610 and the second frame 620 and coupled to the both ends of the first frame 610 and the both ends of the second frame 620.

On the other hand, a part of an upper portion and a part of a lower portion of the filter screen 650 may be inserted into the inner grooves 612 and 622 of the first frame 610 and the second frame 620, respectively. The filter screen 650 prevents dust or foreign matter from flowing into the hollow layer 30 through the air-flowing opening 400 without affecting a circulation or a flow of air through the air-supplying opening 410 and the air-discharging opening 420. Since the filter screen 650 can be easily coupled to and separate from the first frame 610 and the second frame 620, the maintenance can be conveniently performed.

Further, a part of an upper portion and a part of a lower portion of the cover 660 may be inserted into the outer grooves 611 and 621 of the first frame 610 and the second frame 620, respectively. The cover 660 blocks the air-supplying opening 410 and the air-discharging opening 420 and prevents air from flowing or circulating in the hollow layer 30. Accordingly, in winter, the hollow layer 30 forms a heat insulating layer, and the hollow layer 30, the outer window 300, and the inner window 200 act as a triple-glazed window, thereby increasing the heat insulating effect more. In addition, since the cover 660 can be easily coupled to and separated from the first frame 610 and the second frame 620, like the filter screen 650, the air can be allowed to flow or circulate in the hollow layer 30 by conveniently separating the cover 660 in summer.

Next, a window system 10 according to another embodiment of the invention will be described. In the following description, only the portions different from the above-described embodiment will be described in detail and detailed descriptions of the same or similar portions will be omitted.

Figure 9:
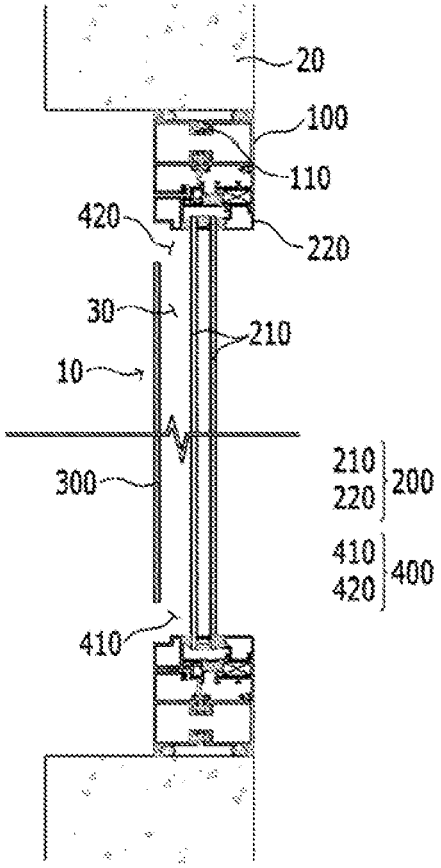
FIG. 9 is a longitudinal sectional view of a window system according to another embodiment of the invention.
Figure 10:
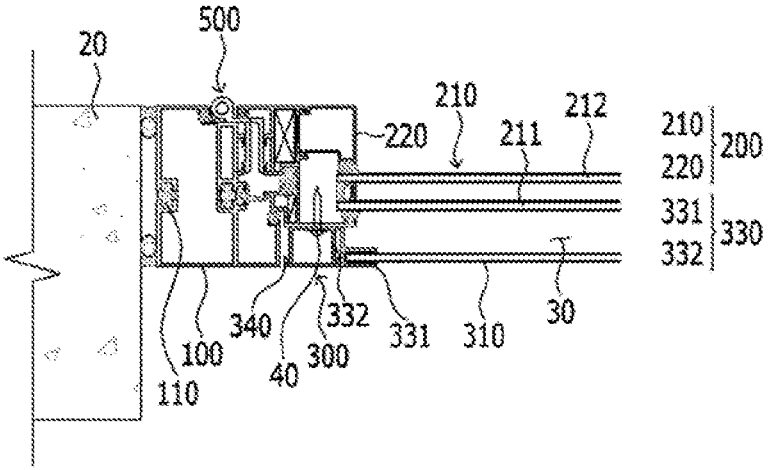
FIG. 10 is a first cross-sectional view of a window system according to another embodiment of the invention.

FIG. 9 is a longitudinal sectional view of a window system according to another embodiment of the invention, FIG. 10 is a first cross-sectional view of a window system according to another embodiment of the invention, and FIG.

11 is a second cross-sectional view of a window system according to another embodiment of the invention.

Figure 11:
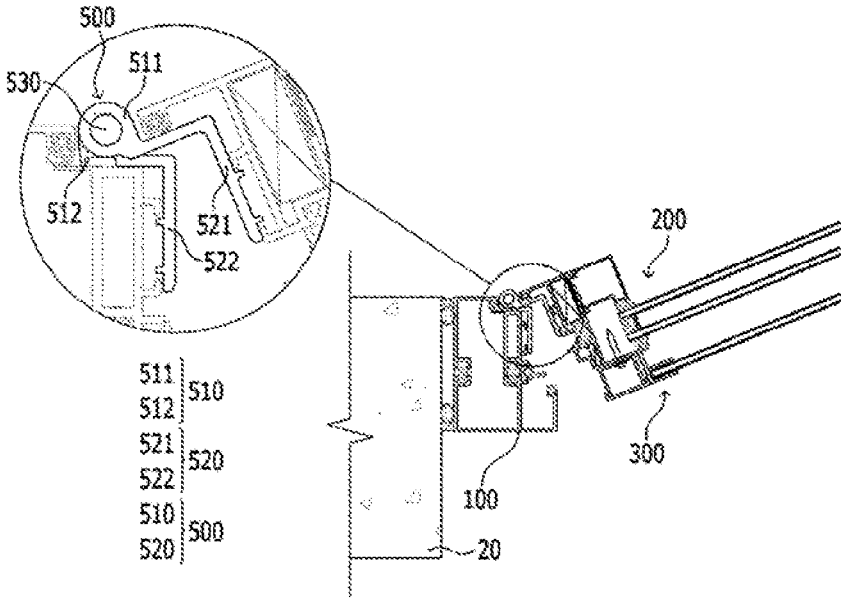
FIG. 11 is a second cross-sectional view of a window system according to another embodiment of the invention.

As shown in FIGS. 9 to 11, a window system 10 according to another embodiment of the invention may include a window frame 100, an inner window 200, an outer window 300, an air-flowing opening 400, and an opening and closing device 500. The inner window 200 may be installed at an indoor side of the window frame 200. The outer window 300 may be fixed to the inner window 200 and spaced apart from the inner window 200 with a predetermined distance at an outdoor side to form a hollow layer 30 between the outer window 300 and the inner window 200. The air-flowing opening 400 may be formed between the outer window 300 and the window frame 100 to form a flow path in which air in the hollow layer 30 flows or circulates. The opening and closing device 500 may be provided at one side of the inner window 200.

In this instance, the outer window 300 is fixed to the inner window 200, not the window frame 100. The inner window 200 and the outer window 300 can be opened and closed from the window frame 100 at the same time by the opening and closing device 500.

Accordingly, both the outside window 300 and the inside window 200 can be open, thereby enabling direct ventilation between an outside and an inside of a room.

Also, the outer window 300 may include a tinted glass 310, a tinted-glass frame 320 to which the tinted glass 310 is fixed and being coupled to the inner window 200, and a frame cover 340 for covering a part of the tinted-glass frame 320. Further, the tinted-glass frame 330 may include a fixing portion 331 and an inner-window coupling portion 332. The tinted glass 310 is fixed to the fixing portion 331. One surface of the inner-window coupling portion 331 faces or is in contact with the inner window 200 to be coupled to the inner window 200. A bolt 40 is fastened to the one surface of the inner window 200 and connects the outer window 300 and the inner window 200. After the bolt 40 is fastened, the cover 660 covers the bolt 40 and an exposure of the bolt 40 is minimized so that the bolt 40 can be protected from an external impact or various foreign matters. Accordingly, a detachment of the outer window 300 from the inner window 200 can be minimized.

On the other hand, a transparent glass having a high absorption rate or a transmittance-controlling glass may be used for the outer window 300, instead to the tinted glass 310.

Next, a window system 10 according to a modified embodiment will be described. In the following description, only the portions different from the above-described embodiment will be described in detail and detailed descriptions of the same or similar portions will be omitted.

Figure 12:
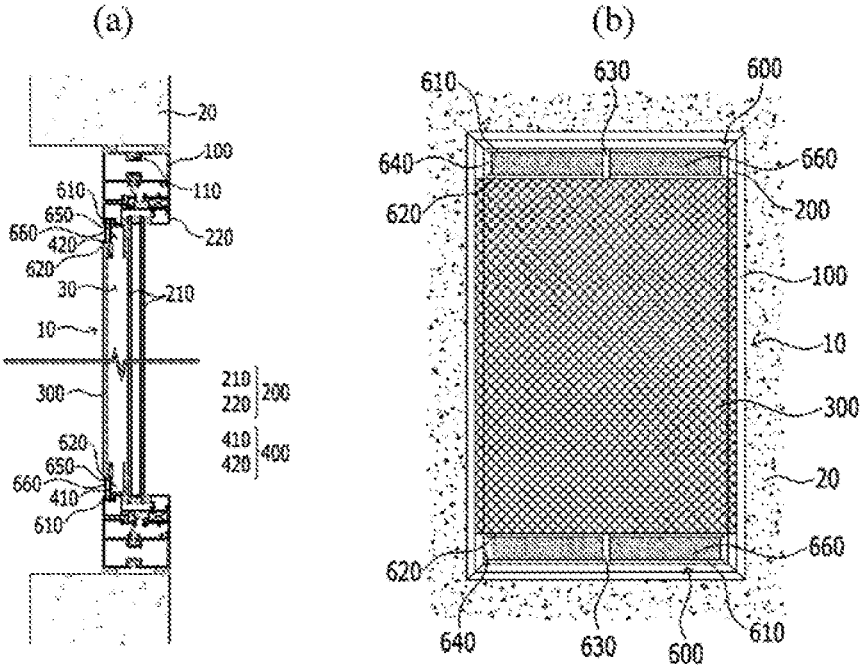
FIG. 12 is a view illustrating a modified embodiment of the window system shown in FIG. 9.

FIG. 12 is a view illustrating a modified embodiment of the window system shown in FIG. 9.

As shown in FIG. 12, an air-supplying opening 410 and an air-discharging opening 420 of a window system 10 according to another embodiment of the invention are provided with an opening and closing frame 600 for opening and closing the air-supplying opening 410 and the air-discharging opening 420.

In this instance, a second frame 620 of the opening and closing frame 600 may face or be in contact with the inner window 200 only, not the inner window 200 and the window frame 100 at the same time. The second frame 620 may have a 'L' or shape. A surface of the second frame 620 may face or be in contact with an upper portion or a lower portion of the inner window 200 and another surface of the second frame 620 may face or be in contact with an upper portion or a lower portion of a first glass 211 of the inner window 200.

A filter screen 650 provided between the first frame 610 and the second frame 620 prevents dust or foreign matter from flowing into the hollow layer 30 through the air-flowing opening 400 without affecting a circulation or a flow of air through the air-supplying opening 410 and the air-discharging opening 420.

Also, since the filter screen 650 can be easily coupled to and separate from the first frame 610 and the second frame 620, the maintenance can be conveniently performed.

A cover 660 provided at a front side of the filter screen 650 blocks the air-supplying opening 410 and the air-discharging opening 420 and prevents air from flowing or circulating in the hollow layer 30. Accordingly, in winter, the hollow layer 30 forms a heat insulating layer, and the hollow layer 30, the outer window 300, and the inner window 200 act as a triple-glazed window, thereby increasing the heat insulating effect more.

In addition, since the cover 660 can be easily coupled to and separated from the first frame 610 and the second frame 620, like the filter screen 650, the air can be allowed to flow or circulate in the hollow layer 30 in summer by conveniently separating the cover 660.

Although window systems according to embodiments of the invention have been described above, the spirit of the invention is not limited to the embodiments shown in this specification. Also, those skilled in the art, who understand the spirit of the invention, can readily suggest other embodiments by adding, changing, deleting, adding, or the like of components, and the other embodiments are within the scope of the invention.

The invention claimed is:

1. A window system configured to block solar radiation without installing a window shade or a blind to control an incidence of solar heat for cooling load reduction, the system comprising:

a window frame;

an inner window installed at an indoor side of the window frame, wherein said inner window has a heat insulating performance;

an outer window fixed to the window frame and spaced apart from the inner window by a predetermined distance at an outdoor side, to form a hollow layer between the outer window and the inner window, wherein said outer window has a heat absorption rate, and transmittance of solar radiation is kept the same so indoor illumination is the same while solar radiation heat is blocked by 30%;

air-flowing openings formed between the outer window and the window frame to form a flow path in which air in the hollow layer flows or circulates; and an opening and closing device provided at one side of the inner window to open and close the inner window from the window frame, wherein said opening and closing device comprises a first coupling unit comprising a first coupling portion and a first connecting portion, a second coupling unit comprising a second coupling portion and second connecting portion, and a rotating shaft, wherein the window system does not have an installed window shade or blind to block solar radiation.

2. The window system of claim 1, wherein the air-flowing opening comprises:

an air-supplying opening formed between a lower end of the window frame and a lower end of the outer window so that air is supplied from outside the window, and an air-discharging opening formed between an upper end of the window frame and an upper end of the outer window to discharge the air introduced into the hollow layer through the air-supplying opening.

3. The window system of claim 2, wherein the air-supplying opening and the air-discharging opening are provided with an opening and closing frame for opening and closing the air-supplying opening and the air-discharging opening.

4. The window system of claim 3, wherein the opening and closing frame comprises:

a first frame installed at the outer window, a second frame installed at the inner window or the window frame, a support member provided between the first frame and the second frame to prevent sagging of the second frame;

finishing members, each provided at both ends of the first frame and the second frame, and coupled to the both ends of the first frame and the both ends of the second frame;

a filter screen disposed between the first frame and the second frame and extending along a longitudinal direction of the air-flowing opening to prevent dust or foreign matter from flowing into the hollow layer through the air-flowing opening.

5. The window system of claim 4, further comprising:

a cover provided at a front side of the filter screen to prevent air from flowing or circulating in the hollow layer through the air-flowing opening.

6. The window system according to claim 1, wherein the opening and closing device further comprises:

the first coupling portion of the first coupling unit coupled to the window frame, and the first connecting portion extending from the first coupling portion;

the second coupling portion of the second coupling unit coupled to an end of the inner window, and the second connecting portion extending from the second coupling portion and being connected to the first coupling portion; and the rotating shaft coupled to the first connecting portion and the second connecting portion to rotate the second coupling unit with respect to the first coupling unit.

7. The window system of claim 1, wherein the inner window comprises:

a pair glass; and a pair-glass frame to which the pair glass is fixed, wherein the pair glass comprises:

a first glass; and a second glass being spaced apart from the first glass by a predetermined distance and being a low-e coated glass.

8. The window system according to claim 2, wherein the opening and closing device comprises:

the first coupling unit including the first coupling portion coupled to the window frame and the first connecting portion extending from the first coupling portion;

the second coupling unit including the second coupling portion coupled to an end of the inner window and the second connecting portion extending from the second coupling portion and being connected to the first coupling portion; and the rotating shaft coupled to the first connecting portion and the second connecting portion to rotate the second coupling unit with respect to the first coupling unit.

9. The window system according to claim 3, wherein the opening and closing device comprises:

the first coupling unit including the first coupling portion coupled to the window frame and the first connecting portion extending from the first coupling portion;

the second coupling unit including the second coupling portion coupled to an end of the inner window and the second connecting portion extending from the second coupling portion and being connected to the first coupling portion; and the rotating shaft coupled to the first connecting portion and the second connecting portion to rotate the second coupling unit with respect to the first coupling unit.

10. The window system according to claim 4, wherein the opening and closing device comprises:

the first coupling unit including the first coupling portion coupled to the window frame and the first connecting portion extending from the first coupling portion;

the second coupling unit including the second coupling portion coupled to an end of the inner window and the second connecting portion extending from the second coupling portion and being connected to the first coupling portion; and the rotating shaft coupled to the first connecting portion and the second connecting portion to rotate the second coupling unit with respect to the first coupling unit.

11. The window system according to claim 5, wherein the opening and closing device comprises:

the first coupling unit including the first coupling portion coupled to the window frame and the first connecting portion extending from the first coupling portion;

the second coupling unit including the second coupling portion coupled to an end of the inner window and the second connecting portion extending from the second coupling portion and being connected to the first coupling portion; and the rotating shaft coupled to the first connecting portion and the second connecting portion to rotate the second coupling unit with respect to the first coupling unit.

12. A window system configured to block solar radiation without installing a window shade or a blind to control an incidence of solar heat for cooling load reduction, the system comprising:

a window frame;

an inner window installed at an indoor side of the window frame, wherein said inner window has a heat insulating performance;

an outer window fixed to the inner window and spaced apart from the inner window by a predetermined distance at an outdoor side to form a hollow layer between the outer window and the inner window, wherein said outer window has a heat absorption rate, and transmittance of solar radiation is kept the same so indoor illumination is the same while solar radiation heat is blocked by 30%;

air-flowing openings formed between the outer window and the window frame to form a flow path in which air in the hollow layer flows or circulates; and an opening and closing device provided at one side of the inner window to open and close the inner window and the outer window from the window frame at the same time, wherein said opening and closing device comprises a first coupling unit comprising a first coupling portion and first connecting portion, a second coupling unit comprising a second coupling portion and second connecting portion, and a rotating shaft, wherein the outer window comprises:

a tinted glass;

a tinted-glass frame to which the tinted glass is fixed and being coupled to the inner window; and a frame cover for covering a part of the tinted-glass frame, and wherein the window system does not have an installed window shade or blind to block solar radiation.

13. The window system of claim 12, wherein the air-flowing openings comprise:

an air-supplying opening formed between a lower end of the window frame and a lower end of the outer window so that air is supplied from an outside, and an air-discharging opening formed between an upper end of the window frame and an upper end of the outer window to discharge the air introduced into the hollow layer through the air-supplying opening.

14. The window system according to claim 13, wherein the opening and closing device comprises:

the first coupling unit including the first coupling portion coupled to the window frame and the first connecting portion extending from the first coupling portion;

the second coupling unit including the second coupling portion coupled to an end of the inner window and the second connecting portion extending from the second coupling portion and being connected to the first coupling portion; and the rotating shaft coupled to the first connecting portion and the second connecting portion to rotate the second coupling unit with respect to the first coupling unit.

15. The window system of claim 13, wherein the tinted-glass frame comprises:

a fixing portion to which the tinted glass is fixed; and an inner-window coupling portion, wherein one surface of the inner-window coupling portion faces or is in contact with the inner window to be coupled to the inner window.

16. The window system of claim 13, wherein the air-supplying opening and the air-discharging opening are provided with an opening and closing frame for opening and closing the air-supplying opening and the air-discharging opening.

17. The window system of claim 16, wherein the opening and closing frame comprises:

a first frame installed at the outer window, a second frame installed at one of, the inner window or the window frame, a support member provided between the first frame and the second frame to prevent sagging of the second frame;

finishing members, each provided at both ends of the first frame and the second frame, and coupled to both ends of the first frame and both ends of the second frame;

a filter screen disposed between the first frame and the second frame and extending along a longitudinal direction of the air-flowing opening to prevent dust or foreign matter from flowing into the hollow layer through the air-flowing opening.

18. The window system according to claim 17, wherein the opening and closing device comprises:

the first coupling unit including the first coupling portion coupled to the window frame and the first connecting portion extending from the first coupling portion;

the second coupling unit including the second coupling portion coupled to an end of the inner window and the second connecting portion extending from the second coupling portion and being connected to the first coupling portion; and the rotating shaft coupled to the first connecting portion and the second connecting portion to rotate the second coupling unit with respect to the first coupling unit.

19. The window system according to claim 16, wherein the opening and closing device comprises:

the first coupling unit including the first coupling portion coupled to the window frame and the first connecting portion extending from the first coupling portion;

the second coupling unit including the second coupling portion coupled to an end of the inner window and the second connecting portion extending from the second coupling portion and being connected to the first coupling portion; and the rotating shaft coupled to the first connecting portion and the second connecting portion to rotate the second coupling unit with respect to the first coupling unit.

* * * * *